United States Patent [19]

Niemann

[11] Patent Number: 5,050,471

[45] Date of Patent: Sep. 24, 1991

[54] APPARATUS FOR SUPPORTING AND GUIDING CIGARETTE RODS AND THE LIKE

[75] Inventor: Helmut Niemann, Ahrensburg, Fed. Rep. of Germany

[73] Assignee: Körber AG, Hamburg, Fed. Rep. of Germany

[21] Appl. No.: 416,962

[22] Filed: Oct. 4, 1989

[30] Foreign Application Priority Data

Oct. 17, 1988 [DE] Fed. Rep. of Germany ..... 3835314

[51] Int. Cl.[5] ..... A24C 5/28

[52] U.S. Cl. ..... 83/310; 83/318; 83/355; 83/580; 83/594; 83/931; 131/65

[58] Field of Search ..... 83/310, 355, 444, 580, 83/931, 628, 632, 594; 131/65

[56] References Cited

U.S. PATENT DOCUMENTS

| | | | |
|---|---|---|---|
| 3,140,632 | 7/1964 | Rowlands et al. . | |
| 3,168,848 | 2/1965 | Bardenhagen | 83/174 |
| 3,215,178 | 11/1965 | Bardenhagen | 146/95 |
| 3,476,002 | 11/1969 | Bardenhagen | 83/310 |
| 3,479,913 | 11/1969 | Goemann et al. | 83/310 |
| 3,518,911 | 7/1970 | Niemann | 83/338 |
| 3,782,229 | 1/1974 | Cristiani | 83/310 |
| 3,815,460 | 6/1974 | Bardenhagen | 83/310 |
| 3,830,126 | 8/1974 | Ringe | 83/310 |
| 3,915,041 | 10/1975 | Trofimov et al. | 83/310 |
| 4,377,098 | 3/1983 | Bardenhagen et al. | 83/310 |

*Primary Examiner*—Douglas D. Watts
*Assistant Examiner*—Scott A. Smith
*Attorney, Agent, or Firm*—Peter K. Kontler

[57] ABSTRACT

A cigarette rod which is repeatedly severed by the orbiting knife of a cut-off is supported by a tubular guide which has a slot for the knife and is moved with the rod in the course of each severing operation to thereupon move back to a starting position. The guide is rigidly connected to and is moved back and forth by the head of a connecting rod which is driven by an eccentric pin and is fixedly connected to the upper end of a single leaf spring. The lower end of the leaf spring is affixed to a stationary support. The head of the connecting rod moves the guide forwardly while the pin advances along the lower portion of its circular path, and the internal surface of the guide is designed in such a way that it supports the rod from below during severing but is spaced apart from the rod during movement to starting position.

8 Claims, 2 Drawing Sheets

59
61
48
28
51
44
43
57
58
62
46
63
56
32
31
64
67
66
47
52
49
54
53
69
68

APPARATUS FOR SUPPORTING AND GUIDING CIGARETTE RODS AND THE LIKE

BACKGROUND OF THE INVENTION

The invention relates to improvements in apparatus for supporting and guiding continuously advancing cigarette rods, cigar rods, cigarillo rods, filter rods, hollow rods (tubes) and/or other rod-shaped products of the tobacco processing industry. More particularly, the invention relates to improvements in apparatus for supporting and guiding an advancing rod during severing by the knife or knives of a severing apparatus. Severing apparatus of the above outlined character, and apparatus for supporting and guiding the advancing rod during severing, are used in cigarette rod making machines, cigar rod making machines, cigarillo rod making machines and filter rod or filter tube making machines.

The following description of the invention will deal primarily with the guidance and severing of cigarette rods in cigarette rod making machines, e.g., in machines of the type known as PROTOS which are distributed by the assignee of the present application. It is to be understood, however, that similar or identical apparatus can be used with equal advantage in cigarillo, cigar or filter making machines.

The severing apparatus (called cut-off) of a cigarette rod making machine is used to subdivide a continuously advancing cigarette rod into plain cigarettes of unit length or multiple unit length. Such cigarettes can be delivered to storage or are transported directly into a packing or filter tipping machine. Since a cigarette rod is relatively soft, it must be adequately supported during severing by an orbiting knife which serves to cut across the rod several thousand times per minute while the rod advances at a speed of several hundred meters per minute. The means for supporting the rod at the severing station normally comprises a tubular guide with a slot or gap for the knife which forms part of the cut-off The guide preferably serves as a counterknife and cooperates with the orbiting knife of the cut-off to ensure the making of clean cuts across the rapidly advancing rod. Moreover, and since the knife should sever the advancing rod in a plane which is normal to the axis of the rod, it is necessary to move the knife with and at the exact speed of the rod each time the knife is in the process of severing the rod. The same applies for the rod supporting guide In other words, the knife carrier of the cut-off must be mounted to carry out alternating forward and rearward movements in and counter to the direction of advancement of the rod, and the same holds true for the guide. The rod is severed each time the knife carrier and the guide move in the direction of advancement of the rod and at the same speed, namely at the speed of advancement of the rod in the cigarette rod making machine.

Apparatus of the above outlined character are well known in the tobacco processing industry. Reference may be had to U.S. Pat. Nos. 3,140,632 to Rowlands et al., 3,168,848 to Bardenhagen et al., 3,215,178 to Bardenhagen, 3,476,002 to Bardenhagen et al., 3,815,460 to Bardenhagen and 3,830,126 to Ringe.

OBJECTS OF THE INVENTION

An object of the invention is to provide a novel and improved apparatus for supporting and guiding a rapidly advancing compact or hollow rod of the tobacco processing industry during subdivision of the rod into sections of desired length.

Another object of the invention is to provide an apparatus which can properly support and guide the rod while the latter advances at a speed which is required to make thousands of rod sections per minute and while the rod advances at a speed of several hundred meters per minute.

A further object of the invention is to provide the rod supporting and guiding apparatus with novel and improved means for properly orienting the rod guide during severing of the rod as well as during movement of the guide with reference to the rod.

An additional object of the invention is to provide novel and improved means for supporting and reciprocating the rod guide.

Still another object of the invention is to provide a rod supporting and guiding apparatus which can be installed in existing rod making machines as a superior substitute for existing apparatus.

An additional object of the invention is to provide an apparatus which is constructed and assembled in such a way that its parts are subject to less pronounced wear and generate less noise than the parts of conventional apparatus.

A further object of the invention is to provide an apparatus which can adequately guide and support a rapidly advancing rod during each and every stage of each severing operation.

Another object of the invention is to provide the above outlined apparatus with a novel and improved rod guide.

An additional object of the invention is to provide a novel and improved crank drive for use in the above outlined rod supporting and guiding apparatus.

SUMMARY OF THE INVENTION

The invention resides in the provision of an apparatus for supporting a rod-like product (such as a cigarette rod) of the tobacco processing industry during subdivision into sections of selected length while the product is advanced at a predetermined speed, in a predetermined direction and along a predetermined path. The improved apparatus comprises guide means which at least partially surrounds a portion of the path, means for alternatingly moving the guide means in the predetermined direction at the predetermined speed and counter to the predetermined direction including a reciprocating member having a motion transmitting portion which is connected with the guide means, and means for supporting the motion transmitting portion The supporting means includes a single leaf spring.

The moving means preferably further includes an input member and means for orbiting the input member along an endless path. The reciprocating member preferably comprises a connecting rod having a second portion which is coupled to the input member. The input member can include or constitute a substantially horizontal crank pin which extends substantially transversely of the predetermined path. That end portion of the connecting rod which is remote from the input member can constitute or resemble a head and includes or constitutes the aforementioned motion transmitting portion of the reciprocating member.

The leaf spring extends substantially transversely of the predetermined path and is preferably a one-armed spring, i.e., a leaf spring which acts not unlike a one-armed lever. At least a portion of the guide means is preferably disposed above the leaf spring, and the upper portion of the leaf spring is preferably fixedly connected with the motion transmitting portion of the reciprocating member, i.e., with the guide means. The lower portion of the leaf spring is preferably fixedly secured to a stationary support.

The axis of the endless path along which the input member of the moving means orbits the second portion of the connecting rod is preferably horizontal, and the connecting rod is preferably located below the predetermined path. The endless path has an upper portion or section and a lower portion or section, and the direction of orbital movement of the input member along the endless path is preferably such that the second portion of the connecting rod moves along the lower portion or section of the endless path while the connecting rod moves the guide means in the predetermined direction.

The guide means includes a product-receiving end and an exit end for separated sections of the product. An internal surface of the guide means adjacent the exit end has a lower portion which is disposed beneath and preferably contacts the product in the predetermined path during movement of the guide means in the predetermined direction. Such internal surface further includes a second or upper portion which is disposed above the predetermined path and slopes upwardly from the lower portion of the internal surface in the predetermined direction. This second portion of the internal surface need not (and preferably should not) contact the product and/or its sections irrespective of the direction of movement of the guide means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
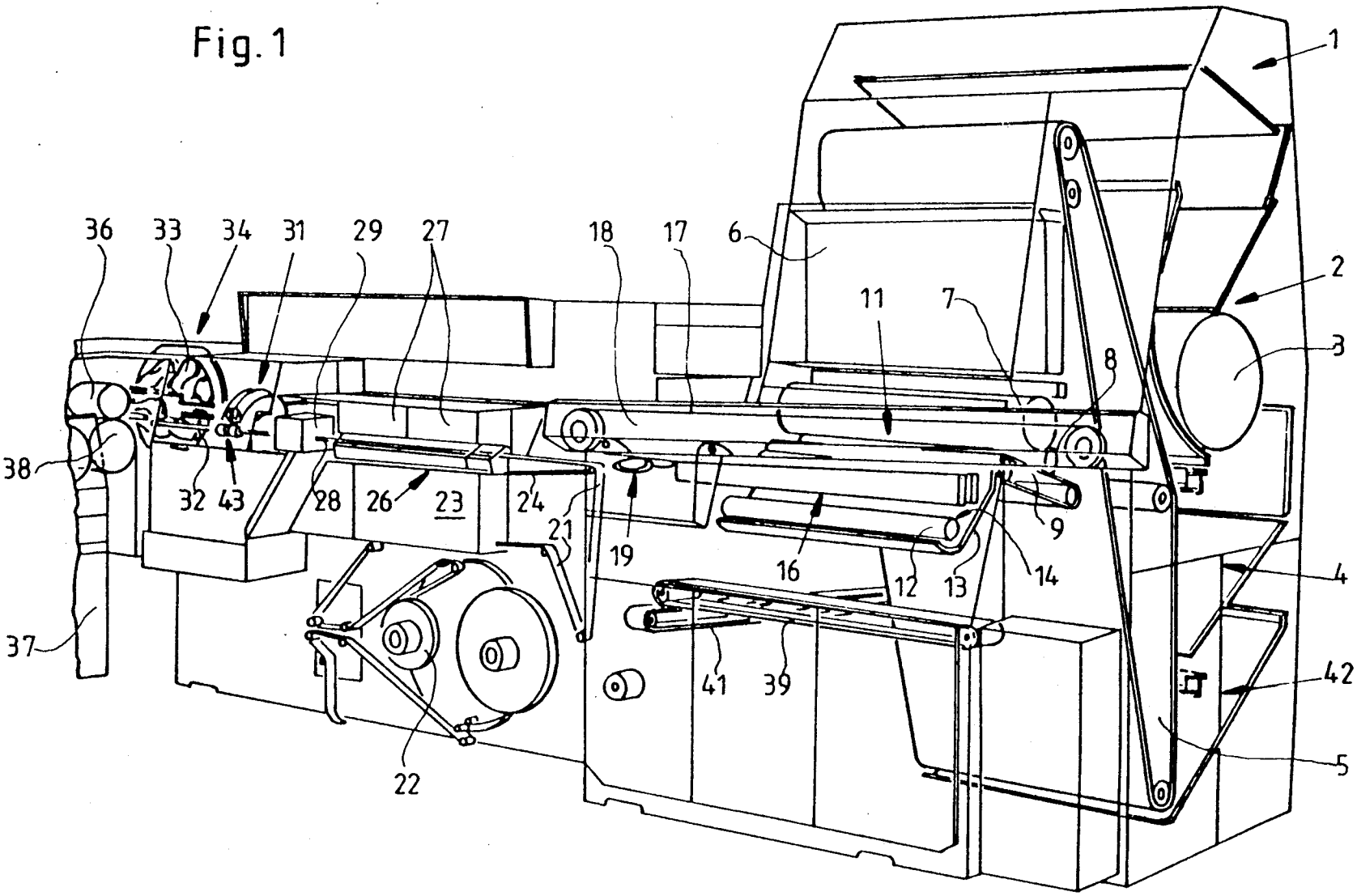
FIG. 1 is a schematic perspective view of a cigarette rod making machine employing a rod supporting and guiding apparatus which embodies one form of the invention.

FIG. 1 shows a cigarette rod making machine which embodies the improved rod guiding and supporting apparatus. The machine comprises a frame which supports a first magazine 2 and a gate 1 which opens at necessary intervals to dump batches of tobacco particles into the magazine 2. A drum-shaped rotary transfer member 3 is provided to deliver tobacco particles at a controlled rate from the first magazine 2 into a second magazine 4 which is adjacent the upwardly moving reach of an endless belt conveyor 5 called elevator and having pockets (not specifically shown) for delivery of metered quantities of tobacco particles into an upright duct 6. The lower end of the duct 6 is adjacent the carding of an elongated drum 7 which draws from the duct a continuous layer of tobacco particles at a substantially constant rate and cooperates with a rapidly rotating picker roller 8. The latter expels tobacco particles from the carding of the conveyor 7 and propels the expelled particles onto the upper reach of a relatively wide belt conveyor 9 which accumulates a carpet of tobacco particles and propels them against an air curtain established by a standard classifying device 11. The heavier particles of tobacco penetrate through and beyond the air curtain to be gathered in a suitable receptacle for evacuation from the rod making machine. The lighter particles (primarily shreds of tobacco leaf laminae) are deflected by the air curtain to enter a funnel 14 which is defined by a second carded drum 12 and a suitably inclined trough-shaped wall 13.

The carded drum propels 12 the particles of tobacco from the funnel 14 into a tobacco channel 16 and against the underside of the lower reach of an elongated endless foraminous belt conveyor 17. A suction chamber 18 above the lower reach of the conveyor 17 ensures that the particles which rise in the channel 16 are attracted to, and accumulate into a continuous tobacco stream at, the underside of the lower reach of the conveyor 17. Such stream contains a surplus of fibrous material, and the surplus is removed by an adjustable trimming or equalizing device 19 downstream of the channel 16. The resulting rod-like tobacco filler is advanced toward and is deposited onto a continuous web 21 of wrapping material (such as cigarette paper) on the upper reach of an endless belt conveyor 24 known as garniture.

The web 21 is drawn off a bobbin 22 and is caused to advance through a customary imprinting mechanism 23 which provides selected portions of the web with indicia (e.g., the trademark of the manufacturer, the name of the manufacturer and/or others). The web 21 and the rod-like filler (trimmed tobacco stream) are caused to advance through a wrapping mechanism 26 wherein the web 21 is draped around the filler in two stages. The first stage involves draping of the web in such a way that one marginal portion of the web projects from the partially draped filler, and such marginal portion is coated with a suitable adhesive by a customary paster, not shown. The second stage involves the application of adhesive-coated marginal portion over the other marginal portion of the web 21 to thus convert the web into a tube which surrounds the filler and has an elongated seam extending in parallelism with the axis of the resulting rod-like product, namely a cigarette rod 28. The seam is heated by a tandem sealer 27 which ensures that the seam can resist stresses which develop when the rod 28 is severed in a severing apparatus 31 which is known as cut-off and is located downstream of a density measuring unit 29. The latter monitors the density of the filler in the rod 28 and transmits appropriate signals to the trimming device 19 which changes the rate of removal of surplus tobacco from the tobacco stream in order to ensure that the density of each increment of the filler in the rod 28 will match an optimum value.

The cut-off 31 which is shown in FIG. 1 is designed to subdivide the rod 28 into plain cigarettes 32 of double unit length. A wheel-shaped transfer conveyor 34 with movable arms 33 is provided to deliver successively formed cigarettes 32, or pairs of successively formed cigarettes 32, to a drum-shaped conveyor 36 of a filter tipping machine 37. The conveyor 36 delivers plain cigarettes 32 to a severing conveyor 38 which cooperates with a rotary circular disc-shaped knife (not shown) to divide each cigarette 32 into a pair of plain cigarettes of unit length.

Endless belt conveyors 39 and 41 are provided to return the removed surplus tobacco from the trimming device 19 into a receptacle 42 adjacent the upwardly moving reach of the elevator conveyor 5 for reintroduction into the duct 6.

The cigarette rod making machine of FIG. 1 is similar to or can be identical with a machine known as PROTOS which is distributed by the assignee of the present application. The filter tipping machine 37 is or can be of the type known as MAX which also distributed by the assignee of the present application.

The cigarette rod making machine further comprises an apparatus 43 which supports and guides the cigarette rod 28 at the severing or subdividing station where the preferably sickle-shaped orbiting knife 51 (FIG. 2) of the cut-off 31 severs the rod 28 at selected intervals to convert the leader of the continuously advancing rod into a file of discrete plain cigarettes 32 of double unit length. The illustrated supporting and guiding apparatus 43 comprises a composite guide having two aligned tubes 44 and 46 which are separated from each other by a clearance or gap 49 (FIGS. 3A and 3B) for the passage of the knife 51 in the course of each severing operation. The tubes 44 and 46 of the guide define an elongated channel or tunnel 47 the narrowest portion of which has a diameter at least slightly exceeding the diameter of the rod 28. The path for the rod 28 is substantially horizontal and this rod is advanced in the direction of arrow 48 at a speed which is determined by the endless belt 24, i.e., by the main prime mover of the cigarette rod making machine.

The upstream tube 44 (as seen in the direction of arrow 48) defines a funnel 52 which forms part of the tunnel 47 and the diameter of which decreases in a direction toward the gap 49. The internal surface of the downstream tube 44 has a concave lower portion 53 which is parallel with the path for the rod 28 and actually contacts the tubular wrapper of the rod during movement of the tubes 44 and 46 in the direction of arrow 48 at the speed of the rod 28. The upper portion 54 of the internal surface of the tube 46 slopes upwardly and away from the lower portion 53 in a direction away from the gap 49 (i.e., in the direction of arrow 48) to such an extent that it does not contact the rod 28 (or the rearmost plain cigarette 32) irrespective of the orientation of the tubes 44 and 46, i.e., irrespective of whether the guide moves forwardly (arrow 68 in FIG. 3A) or rearwardly (arrow 69 in FIG. 3B).

The funnel 52 at the product-receiving end of the tube serves to steer the leader of a rod 28 into the downstream tube 46 when the cigarette rod making machine is started. That portion of the tunnel 47 which is defined by the downstream tube 46 can be said to resemble a funnel which is located at the exit end of the guide and diverges in a direction away from the gap 49. This portion of the tunnel 47 is bounded by the aforediscussed lower and upper portions 53, 54 of the internal surface of the tube 46.

The means for alternatingly moving the tubes 44, 46 in directions which are indicated by arrows 68 and 69 comprises a reciprocating member 57 which is a connecting rod forming part of a crank drive 58. The latter further comprises an input member 61 in the form of a horizontal crank pin extending transversely of the direction which is indicated by the arrow 48, and a disc 59 which is driven by the main prime mover of the cigarette rod making machine and orbits the pin 61 about a horizontal axis at a level beneath the path for the rod 28. The disc 59 causes the pin 61 to orbit clockwise along an endless circular path, and that end portion or head 56 of the connecting rod 57 which is remote from the pin 61 is fixedly connected to the guide including the tubes 44 and 46. The arrangement is such that the pin 61 moves along the lower portion of its endless path while causing the connecting rod 57 to move the tubes 44, 46 in the direction of arrow 68 at the speed of the rod 28, and that the crank pin 61 moves along the upper portion of its endless circular path during movement of the guide including the tubes 44 and 46 in the direction of arrow 69, i.e., counter to the direction of advancement of successive increments of the rod 28 toward and into the tunnel 47 of the guide.

The exact manner in which the rear portion of the connecting rod 57 is mounted on the crank pin 61 forms no part of the invention. The head 56 is fixedly secured to the tubes 44, 46 as well as to the upper portion of a single leaf spring 67 forming part of a supporting means 64 for the head 56. The lower portion of the leaf spring 67 is fixedly connected to a stationary support 66. The support 66, at least the major portion of the leaf spring 67, the connecting rod 57 and the remaining components of the crank drive 58 are located below the path for the rod 28. The disc 59 for the crank pin 61 derives motion from the main prime mover of the cigarette rod making machine and is driven in synchronism with the knife 51 of the cut-off 31 as well as in synchronism with the belt conveyor 24 so that, when the knife 51 enters the gap 49 between the tubes 44 and 46, the connecting rod 57 moves the tubes 44, 46 in the direction of arrow 48 (arrow 68 in FIG. 3A) and at the exact speed of the rod. This ensures that the knife 51 makes a clean cut in a plane which is normal to the axis of the rod 28. The knife 51 is mounted on a carrier 63 which is carried by a universal joint in the housing 62 of the cut-off 31. The latter can be similar to that which is disclosed in U.S. Pat. No. 3,518,911 granted July 7, 1970 to Helmut Niemann et al. for "Cutting mechanism for tobacco or the like". The cut-off 31 ensures that the knife 51 moves in the direction of arrow 48 and at the exact speed of the rod 28 (i.e., at the exact speed of the tubes 44 and 46) during travel through the gap 47, i.e., in the course of each severing operation.

The leaf spring 67 can be made of a so-called CFK material which includes carbon filaments held together by a binder of epoxy resin.

Figures 2, 3A, 3B:
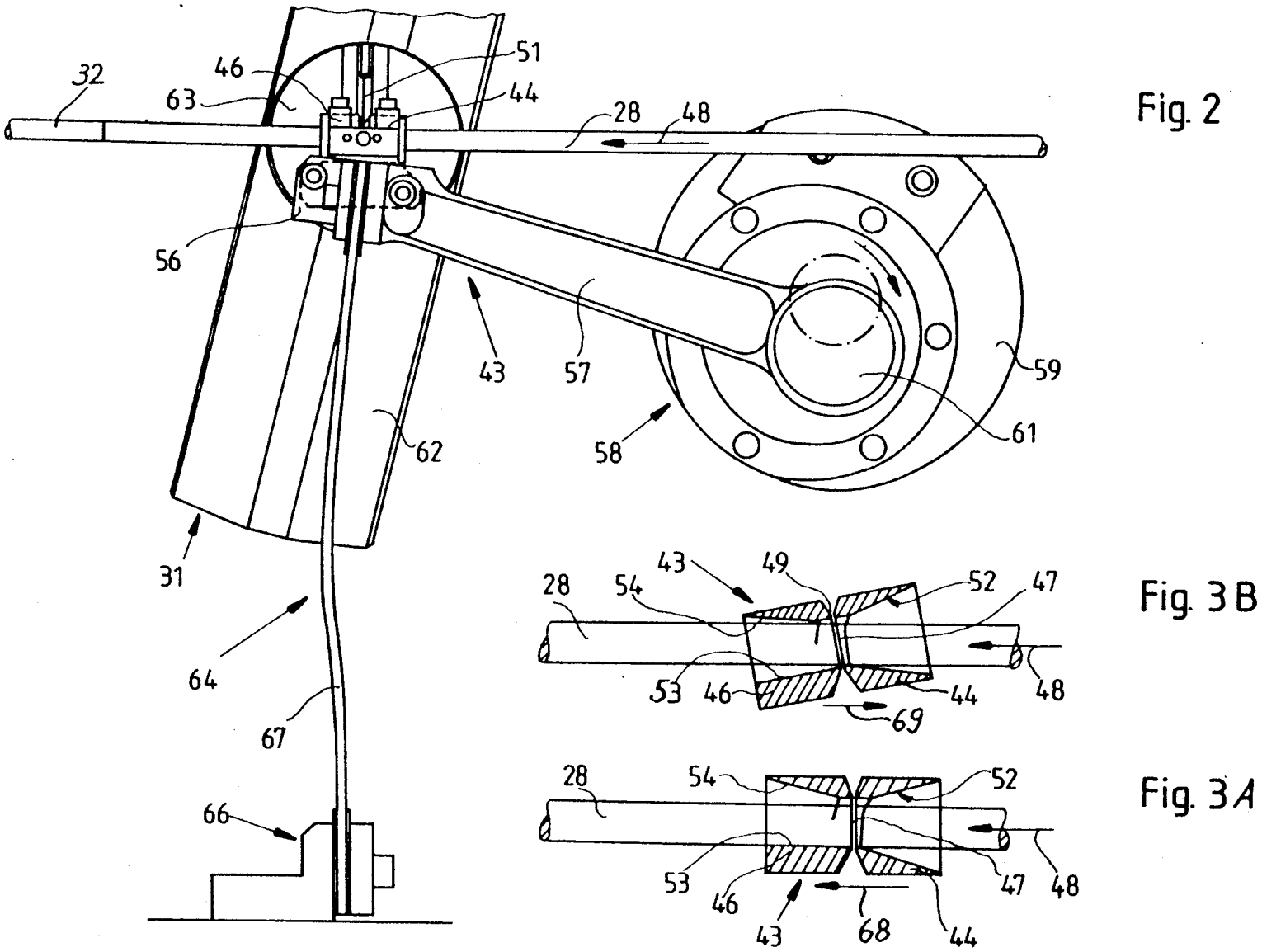
FIG. 2 is an enlarged side elevational view of the rod supporting apparatus.
FIG. 3A is an enlarged view of a detail in the apparatus of FIG. 2, with the tubes of the guide means shown in a vertical sectional view and in the process of advancing with the rod.
FIG. 3B illustrates the structure of FIG. 3A but in a slightly different orientation during movement of the tubes counter to the direction of advancement of the rod.

The operation of the rod supporting and guiding apparatus 43 is as follows:

As mentioned above, the disc 59 causes the crank pin 61 to orbit in a clockwise direction (as seen in FIG. 2) and to move the head 56 of the connecting rod 57 (and hence the tubes 44 and 46) in the direction of arrow 48 while the pin 61 advances along the lower portion or section of its endless path. At such time, the speed of movement of the knife carrier 63 in the direction of arrow 48 matches the speed of the rod 28 and the speed of the tubes 44 and 46 (arrow 68 in FIG. 3A). The speed of the tubes 44 and 46 matches the speed of the rod 28 and knife carrier 63 in the direction of arrow 48 at least during each interval of movement of the knife 51 in the gap 49.

The underside of the rod 28 in the tube 46 rests on the lower portion 53 of the internal surface of this tube while the cutting edge of the knife 51 severs the rod. The guide including the tubes 44 and 46 then constitutes a counterknife and cooperates with the knife 51 to make a clean cut. The portion 54 of internal surface of the tube 46 is spaced apart from the adjacent portion of the rod 28 or from the adjacent portion of the rearmost cigarette 32 of double unit length.

Each revolution of the disc 59 results in a movement of the head 56 of the connecting rod 57 along an elongated arcuate path which includes a practically or nearly straight portion or section extending in substantial parallelism with the path for the rod 28. The head 56 advances (with the tubes 44, 46) along such substantially straight portion of its path while the guide moves in the direction of arrow 68, i.e., in the direction of movement of the rod 28 and at the same speed This ensures that the portion 53 of the internal surface of the tube 46 can optimally support the rod 28 in the course of each severing operation. The connecting rod 57 causes a certain change of orientation of the tubes 44 and 46 (compare FIGS. 3A and 3B) during deceleration of the guide in the direction of arrow 68 and during movement counter to such direction (arrow 69 in FIG. 3B). At such time, the entire internal surface of the guide including the tubes 44 and 46 is preferably out of contact with the wrapper of the rod 28 (see FIG. 3B). The change of orientation from that shown in FIG. 3A to that which is shown in FIG. 3B is in a single direction. The leaf spring 67 ensures that the head 56 of the connecting rod 57 and the tubes 44, 46 are maintained at an optimum level with reference to the path for the rod 28 and with reference to the path of orbital movement of the knife 51.

An advantage of the supporting means 64 including the leaf spring 67 is that it can prevent excessive vibratory movements of the head 56 of the connecting rod 57 and of the guide including the tubes 44 and 46. This is believed to be attributable to the aforedescribed orientation of the leaf spring 67 substantially transversely of and to its positioning beneath the path for the rod 28 and to attachment of the two end portions of the leaf spring to the stationary support 66 and head 56. A fixed connection between the upper portion of the leaf spring 67 and the head 56 is preferred at this time because this reduces the likelihood of friction and resulting wear and generation of heat. The aforediscussed selection of connection between the connecting rod 57 and other parts of the crank drive 58 (so that the tubes 44 and 46 are moved in the direction of arrow 68 while the crank pin 61 advances along the lower portion of its endless circular path) has been found to result in the establishment of optimal kinematic conditions as concerns the guidance of the rod 28 during severing and adequate support for the rod during penetration of the knife 51 into and through the gap 49.

The aforediscussed positioning and orientation of portions 53 and 54 of the internal surface of the tube 46 ensure a highly satisfactory guidance of and support for the rod 28 and cigarettes 32 during forward movement of the head 56 in the direction of arrow 68 as well as unimpeded forward movement of the rod while the guide including the tubes 44 and 46 moves in the direction of arrow 69, i.e., counter to the direction of forward movement of the rod.

Another important advantage of the improved apparatus 43 is that the supporting means 64 (including a single leaf spring 67) is simple, lightweight, compact and inexpensive. In addition, the wear upon the head 56 of the connecting rod 57, upon the stationary support 66 and upon the leaf spring 67 is practically nil because there is no need for frictional or other sliding engagement between such parts. This results in a reduction of maintenance cost. Still further, such mounting of the head 56 on the leaf spring 67 and of the leaf spring in the support 66 contributes to a pronounced reduction of noise when the rod supporting and guiding apparatus 43 is in actual use.

Still another advantage of the improved apparatus 43 is that the aforediscussed connection between the connecting rod 57 and other parts of the crank drive 58, as well as between the connecting rod and the leaf spring 67 and tubes 44, 46, ensures that the tubes 44, 46 cover a considerable distance in the direction of arrow 68 while advancing at the speed of the rod 28 to thus ensure optimum guidance of the rod 28 in the course of each severing operation. In other words, the path of movement of the center of the guide including the tubes 44 and 46 is not a circular path but rather a composite path with an elongated portion extending in parallelism with the path of movement of the rod 28 each time the rod is being severed by the knife 51. This enables the lower portion 53 of internal surface of the tube 46 to adequately support the rod 28 during penetration of the knife 51 into and during its advancement through the gap 49.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for supporting a rod-like product of the tobacco processing industry during subdivision into sections of selected length while the product is advanced at a predetermined speed, in a predetermined direction and along a predetermined path, comprising guide means at least partially surrounding a portion of said path; means for alternatingly moving said guide means in said direction at said speed and counter to said direction, including a reciprocating member having a motion transmitting portion connected with said guide means, an input member and means for orbiting said input member along an endless path, a single one-armed leaf spring extending substantially transversely of said path for supporting said motion transmitting portion, said reciprocating member comprising a connecting rod having a second portion coupled to said input member and said connecting rod comprising a head which constitutes said motion transmitting portion and is fixedly connected to said leaf spring.

2. The apparatus of claim 1, wherein said input member includes a substantially horizontal crank pin extending substantially transversely of said predetermined path.

3. The apparatus of claim 1, wherein said guide means is disposed at least in part above said leaf spring, said leaf spring having an upper portion connected with said motion transmitting portion and a lower portion, and further comprising a stationary support for the lower portion of said leaf spring.

4. The apparatus of claim 1, further comprising means for fixedly connecting said motion transmitting portion to said leaf spring.

5. The apparatus of claim 1, wherein said motion transmitting portion is located below said predetermined path and said orbiting means comprises means for orbiting said input member about a substantially horizontal axis said endless path having an upper section and a lower section and said second portion of said connecting rod moving along the lower section of said endless path during movement of said guide means in said predetermined direction.

6. The apparatus of claim 1, wherein said guide means includes a product receiving end and an exit end and has an internal surface adjacent said exit end, said internal surface having a lower portion which is disposed beneath said path and is parallel to such path during movement of said guide means in said direction.

7. The apparatus of claim 6, wherein said internal surface has a second portion which is disposed above said path and slopes upwardly and away from said lower portion in said direction.

8. The apparatus of claim 7, wherein said lower portion contacts the product in said guide means during movement of the guide means in said direction and said second portion of said internal surface is out of contact with the product during movement of the guide means in either direction.

* * * * *